United States Patent [19]

Arno' et al.

[11] 4,405,364

[45] Sep. 20, 1983

[54] PROCESS OF REFINING IRON IN OXYGEN CONVERTERS WITH ADDITIONS OF MATERIALS CONTAINING SODIUM CARBONATE

[75] Inventors: Mario Arno', Campi Salentina; Bruno Costa, Naples, both of Italy

[73] Assignee: Nuova Italsider S.p.A., Genoa, Italy

[21] Appl. No.: 379,082

[22] Filed: May 17, 1982

[30] Foreign Application Priority Data

May 20, 1981 [IT] Italy ..... 40430 A/81
Feb. 16, 1982 [IT] Italy ..... 12439 A/82

[51] Int. Cl.[3] ..... C21C 7/00; C22B 9/10
[52] U.S. Cl. ..... 75/52; 75/53
[58] Field of Search ..... 75/52, 53–56

[56] References Cited

U.S. PATENT DOCUMENTS 3,158,465 11/1964 Brown ..... 75/57
4,189,318 2/1980 Zorev ..... 75/53
4,290,809 9/1981 Loane ..... 75/53

*Primary Examiner*—P. D. Rosenberg
*Attorney, Agent, or Firm*—Robert E. Burns; Emmanuel J. Lobato; Bruce L. Adams

[57] ABSTRACT

The above invention concerns the use of sodium carbonate and various mixtures thereof in furnaces for converting iron while blowing with oxygen.

This compound, suitably prepared and added to the converter with sufficient operator skill, permits one to take care of well known limitations of rapid conversion processes, notably increasing reactions removing elements which are not wanted in steel, in particular phosphorus and sulphur.

After careful examination of all the aspects of the use of said materials in converters, those conditions have been identified which permit one to use with success this new method with sodium slags in all types of processing involving oxygen blowing.

7 Claims, 2 Drawing Figures

PROCESS OF REFINING IRON IN OXYGEN CONVERTERS WITH ADDITIONS OF MATERIALS CONTAINING SODIUM CARBONATE

BACKGROUND OF THE INVENTION

Modern conversion processes, namely LD (BOF), LD-AC, KALDO etc, which use oxygen blowing from above, as well as those in which the oxygen is fed from below, namely OBM (Q BOP), LWS, etc, have limitations in respect of the efficiency of the desulphurization and dephosphorization reactions. These limitations, which only permit poor elimination of sulphur and of phosphorus from the metal bath, do not allow one to meet, on the one hand, the requirements of steels with high quality and mechanical requirements, such as toughness, and on the other hand the worsening of the primary materials, above all of the fossil fuels in respect of sulphur and phosphorus content, given that, under the impetus of the present energy crisis, it would be opportune to use those that are available, without too many limitations.

A recent tendency to counterbalance these difficulties has caused one to introduce treatment upstream and downstream of the process of making the steel in the converter, that is new processes which are inserted in the metallurgical cycle and which permit the formation of products of higher quality. Only in a few cases has one been able to use such treatments also to permit the advantages of providing less valued fossil fuels.

The treatments carried out on the liquid iron in general permit the sulphur content to be reduced, but only more recently are being put into practice other treatments which permit the phosphorus content to be reduced.

Treatments carried out downstream, that is on the steel, in general have other purposes such as deoxidization, degasing, etc, but can also allow sulphur inclusions to be formed into globules and also the further lowering of the sulphur content and sometimes also of the phosphorus content.

It is evident that increasing the number of fundamental process also increases the complexity of the production cycle and in general the cost of steel making.

OBJECTS OF THE INVENTION

The process according to the invention permits one not to follow the tendency indicated above, but to use other possibilities for oxygen conversion which, until now, have not yet been taken into consideration and have not been used due to lack of a convenient way of putting them into practice, which was suitable for industrial processes.

It will be shown that the process according to the present invention involves, as well as the part concerned with making steel in the converter which will be described at length below, also plants for cooling and treating fumes, treating water and sediments, etc.

DESCRIPTION OF THE PREFERRED EMBODIMENT

Figure 1:
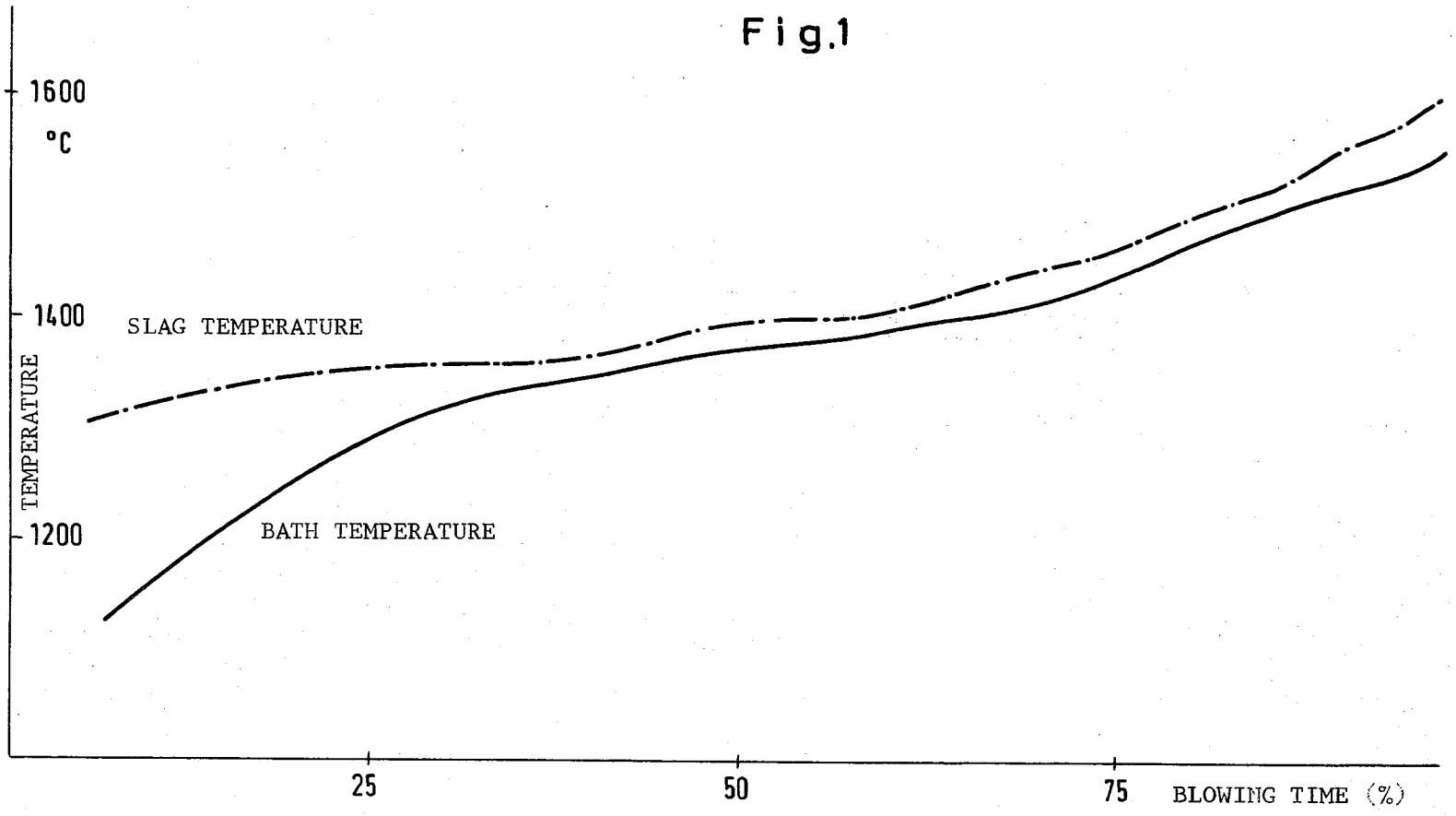
FIG. 1 is a diagram showing the slag and molten metal temperatures with respect to the blowing time percentages

To illustrate in the most profound way the limitations of present conversion processes, which, as is known, are based on slags containing principally compounds of calcium and magnesium as basic compounds, as well as those which are formed by oxidation of the elements contained in the metallic, bath, such as MnO, one should consider the following relationship which provides the amount of material (sulphur or phosphorus) removed in unit time per unit volume.

The index "i" refers to the sulphur or to the phosphorus. In the symbols which follow, the round brackets refer to the slag and the square brackets refer to the metallic bath.

$$\frac{dn_i}{dt} = \frac{M_i}{\frac{1}{\beta[1]\cdot[x_i]} + \frac{1}{\eta i\cdot\beta(i)\cdot 2}}\cdot\frac{A}{m}\left([x_i] - \frac{(x_i)}{\eta i}\right) \quad (1)$$

where $n_i$=number of moles transported from the metallic bath to the slag $M_i$=atomic weight of the element $\beta_{[i]}$=mass coefficient of transport of the metal $\beta_{(i)}$=mass coefficient of transport of the slag $[X_i]$=weight concentration of the metal $(X_i)$=weight concentration of the slag $\eta_i$=partition coefficient Q=quantity of slag A=reaction surface m=mass of liquid bath Thus the quantity of sulphur and phosphorus removed depends, as can be seen from formula (1), on three factors:

1. The deviation of the actual conditions in the bath from the equilibrium conditions with the slag measured in accordance with $$[X_i]-(X_i)/\eta_i$$

2. On the specific surface across which the mass is transported:

$$A/m$$

3. On the mass coefficients of exchange: $\beta_{(i)}$ and $\beta_{[i]}$

A recent tendency, which is novel over known processes, and which has caused the introduction of a series of new processes, proposes to improve the contact between the phases slag-metallic bath, by means of an intensification of the agitation so as to use the desulphurizing and dephosphorizing capacities of the slags more fully.

Examples of new processes are those called LBE, LD-OB, LDKG, LD-STB, LD-CL and that called blowing in unstationary manner described in U.S. Pat. No. 4,043,799. In general these processes for improving the degree of completion of the reactions with the slag in the course of blowing act preferentially in accordance with the transport equation which represent the exchange surface, i.e.: A/m Said processes allow one to obtain simultaneously, as well as the benefit of a greater elimination of sulphur and phosphorus from the bath, also a reduction in the amount of oxidized iron. Because of this, the same process mechanisms, with a high degree of mixing, allow the oxidation of the iron to be reduced in the final phase. Nonetheless, in all the processes considered, the desulphurization and the dephosphurization together with other reactions following the oxidation of silicon and manganese, are carried out by slags containing basic oxides such as CaO and MgO coming from suitable added materials: lime, limestone, magnesium, line, burned dolomite, etc.

Other compounds of other materials can also be contained as impurities or can come from synthetic slags.

It is to be observed that in current industrial practice before the present invention, the desulphurizing and dephosphorizing capacities of sodium compounds such as sodium carbonate have been ignored. This last compound, as simple $Na_2O$, which is obtained from the decomposition of said carbonate, has high desulphurizing and dephosphorizing capacities; both compounds are suitable for use in oxidizing environments. When considered as a constituent of the slag, $Na_2O$ has a very high equilibrium constant K for the desulphurizing and dephosphorizing reactions (Na+).

The partition coefficient ($\eta$) of sulphur and phosphorus between the slag and the metallic bath depends on the compounds forming the slag by way of the equilibrium constant K, where the symbol (j) indicates a basic constituent of the slag.

This is obtained from the following expression, which applies to desulphurization:

$$\eta s = \frac{K(^{N}O--)\,(f_{\cdot s})}{(f_o \cdot \%\ O)}$$

AS Kj is the value of the individual thermodynamic constants of the fundamental reactions, the values of Kj reported by R. G. WARD give the desulphurizing power of the various ions relative to $Ca^{++}$ which is made equal to 1. Doing this, one finds that while $Fe^{++}$, $Mn^{++}$, $Mg^{++}$ have a desulphurizing power less than that of $Ca^{30}+$, the desulphurizing power of the sodium ion is 1070 times greater.

A first objective of the claimed process is to operate the oxygen conversion in the presence of slags also containing compounds of sodium, such as $Na_2O$, and for this purpose, the new process comprises making additions to the converter of materials also containing sodium compounds, in particular sodium carbonate alone or mixed with order materials in suitable conditions.

Taking relation (1) into account, the proposed process allows one to act predominently on the term $\eta i$, that is on the so called equilibrium partition coefficient.

As the sodium compounds used appear as $Na_2O$ in the oxidized form, resulting from the decompositon of the carbonate according to the reaction:

$$Na_2CO_3 \rightleftharpoons Na_2O + CO_2 \qquad (2)$$

there are no reasons for forbidding their use in the physical oxidizing conditions which occur in the converters referred to in the beginning, that is at least from the thermodynamic point of view.

In the course of the conversion process, the temperatures are such as to favour the evaporation of sodium compounds immersed in the system rather than to allow their remaining as components of the slag. This difficulty is overcome by the claimed process. In fact the fusion temperature ($T_M$) and the boiling point ($T_B$) of said $Na_2O$ are respectively:

$T_M = 917°$ C. $T_B = 1275°$ C.

Figure 2:
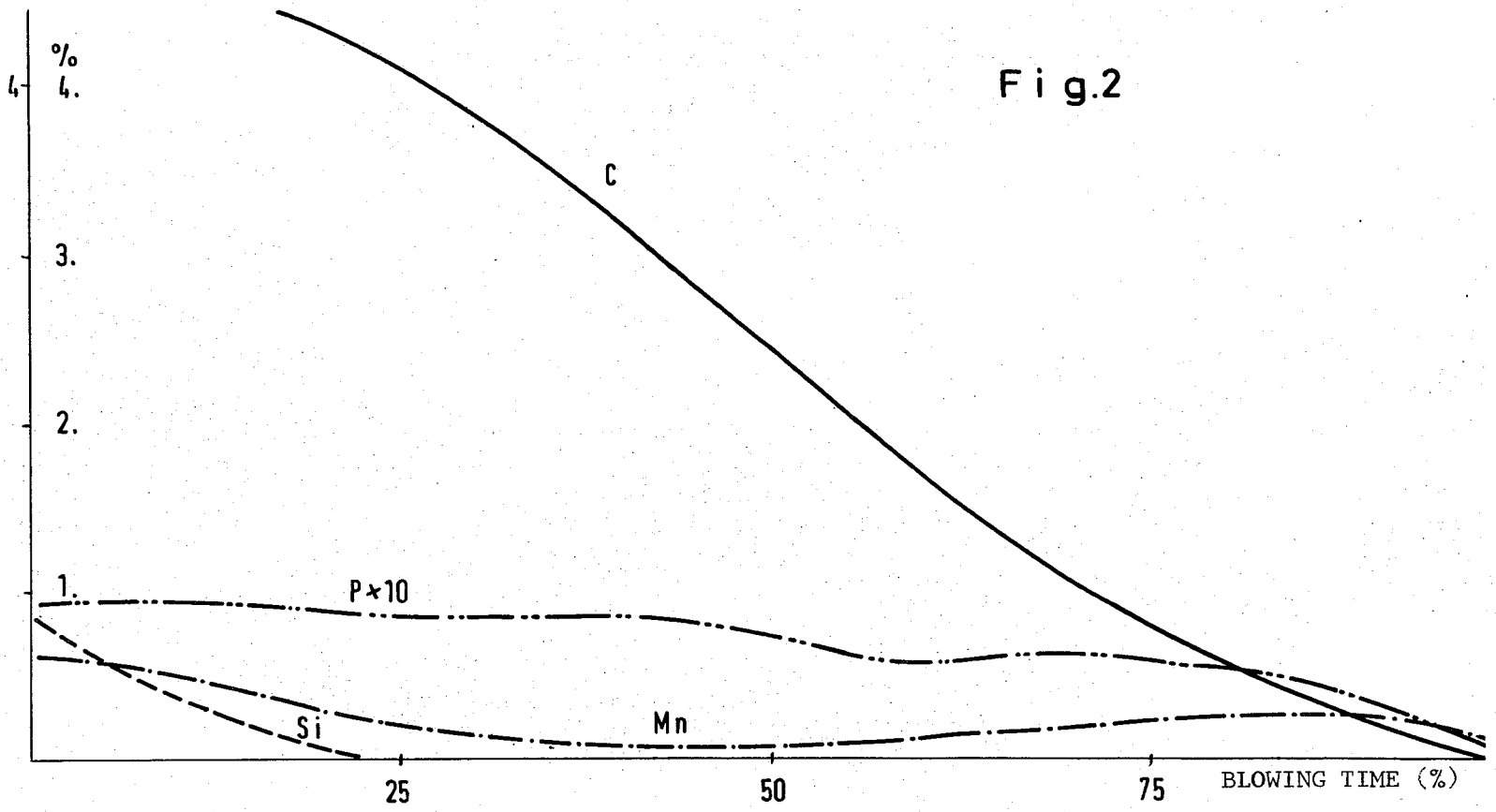
FIG. 2 is a diagram showing the C, P, Mn and Si percentages with respect to the blowing time percentages.

FIG. 1 shows the progress of the composition of the bath, for which purposes it can be useful to compare the two Figures (FIG. 2).

It is well known from the use of sodium carbonate as a slag desulphurizer that, in order to obtain a good result; it is necessary to inject the compound at a great depth.

This has the purpose of allowing contact with the iron before the conditions existing also in this process cause the evaporation of the desulphurizer into the atmosphere. It is also known that a analogeous technique is adopted for magnesium in desulphurizing operations since this element has a boiling point less than the temperature of use (Tb = 1107° C.).

A another technique is also known of using magnesium consisting in using materials impregnated with magnesium in suitable sizes, materials from which the magnesium itself is gradually released and can carry out the desulphurizing action before evaporating into the atmosphere above.

Unfortunately it was not possible to apply also to sodium compounds to a certain extent such techniques applied to magnesium compounds.

Consequently, a second characterising objective of the present invention is that of indicating, by the physical conditions existing in the converters, the manner to add the sodium compounds in the slag inspite of its relatively low boiling point.

This objective is achieved according to the present invention, while blowing oxygen into the liquid bath, by introducing from above in the case of LD type converters, materials containing sodium carbonate in the form of brickettes of appropriate size which, as a result of their gradual solution in the slag, contribute to the desulphurization and dephosphorization reactions.

In the proposed precess, the above reactions are carried out, according to what is considered known at present, by the compound $Na_2O$ coming from the sodium carbonate contained in the added materials.

The reactions which occur are the following, in addition to (2):

$$2\,Na_2CO_3 + Si = 2\,Na_2\overset{|}{\underset{|}{O}} + \overset{|}{\underset{|}{SiO'_{2'}}} + \overset{|}{\underset{|}{CO}} \qquad (3)$$

$$Na_2CO_3 + Si = Na_2\overset{|}{\underset{|}{O}} + \overset{|}{\underset{|}{SiO'_{2'}}} + \overset{|}{\underset{|}{C}} \qquad (4)$$

The compound silica combines again with $Na_2O$ according to the reaction:

$$Na_2O + SiO_2 = Na_2SiO_3 \qquad (5)$$

Thus there results the formation of a slag rich in $Na_2O$ which contributes to the desulphurization and dephosphorization reactions, according to the reactions:

$$3Na_2O + 2P + 5O = Na_2O.P_2O_5 \qquad (6)$$

$$Na_2O + FeS = Na_2S + FeO \qquad (7)$$

During the addition of the above materials in the converter, it happens that the solid particles are dragged upwards by the gas or fume current, given that these gases or fumes reach notable velocities because of the blowing. This negative effect is added to that caused by the evaporation which follows the decomposition of the sodium carbonate at high temperatures. Taking this into account, one finds that: another objective of the process claimed by the present invention is that of avoiding dragging along the fines. For this reason, one adds during the oxygen blowing, from above in the case of LD type converters, mixtures of different materials with sodium carbonate in brickettes of suitable average dimensions, but such that the fraction of those with average dimensions lower than 10 mm is very limited.

It is known that the desulphurization and dephosphorization reactions in the converters when blowing from above occur either in the impact zone, in particular towards the side surface of the zones where movements are generated which drag along the slag, carrying it into contact with the liquid metal, or in the emulsion of slag-metal-gas emerging from the bath, where are formed, and remain for a certain interval of time, particles of liquid metal generated and moved by the oxygen jets; in both cases, the exchange of material occurs from or towards particles of small dimensions.

For this reason, another important objective of the present invention is the dispersion of the desulphurizing and dephosphorizing agent sodium carbonate, which is effected by distributing this latter in the form of solid mixtures with other substances.

Taking account of the ways of fabrication normally used and the materials is most common use, these other substances can be $CaCO_3$, CaO, MgO, $MgCO_3$, iron oxides, slags obtained by the conversion, etc. It is evident that use of these types of mixtures, as well as the use of a compound which is strongly volatile at the temperatures of the intermediate phase of conversion, have the advantage of increasing the number of reaction centers. In this way, one succeeds in influencing reactions (6) and (7), increasing their efficiency in respect of the second of the factors revealed by relation (1), that is the specific exchange surface.

This is obtained by precise dimensioning of the said brickettes. Regarding the process of formation of the slag, it is also known from the many studies that have been made that the dissolution of lime in the slag is made difficult by the formation of calcium metasilicate and orthosilicate on the surfaces of the lime particles in contact with the slag. The barrier of silicates, which are compounds with a high melting point, make difficult the final dissolution of the same. In current conversion practice, to reduce this effect, substances like $CaF_2$ or other substances which have similar properties, are added, or one entrusts to the FeO the task of forming compounds which are in the liquid state at the temperature of process. In the process claimed by the present invention, it is possible, avoiding the use of these materials, to use the property of sodium compounds which are already present and which have a low fusion point as can be seen from the following table:

| | $Na_2SiO_3$ | $Na_4SiO_4$ | $Na_2SO_4$ | $Na_3PO_4$ | $Na_4P_2O_7$ |
|---|---|---|---|---|---|
| $T_M$ °C. | 1088 | 1018 | 884 | 1340 | 988 |

The presence of sodium carbonate in the specified form, that is in a solid-solid dispersion with other compounds, makes this possible and is a further intention of the present invention. Another objective of the present invention is that of using a predetermined blowing period which is better adapted to obtain high efficiency of the desulphurization and dephosphorization reactions.

It is a fact known that the initial phase of blowing, during which the combustion of the silicon present in the iron occurs preferentially (see FIG. 2) is also that phase in which is formed an active slag which causes a lowering of the phosphorus percentage and of the sulphur percentage. After this phase, when the greatest speed of decarburization is reached, the conditions of the slag, either because of its reduced oxidation or for the delay in the dissolution of the lime due to the causes illustrated, do not permit appreciable progress in the metal-slag reactions.

Given the physical characteristics of the system, i.e. the composition of the slag and of the melt (FIG. 2) and the temperature of the same (FIG. 1), and given the particular physical state i.e. the dispersion, the particle sizes as well as the temperature when passing through the various states, already referred to, it is just in this period that reactions indicated as (6) and (7) can occur. It is further noted that in this second phase of blowing, the probably negative contribution of the reaction with the silica does not occur. The process claimed probably permits one to achieve an intermediate phase in which the slag-metal reactions are active and in a specific manner, the desulphurization and dephosphorization reactions which are carried out preponderantly by the sodium compounds ($Na_2O$) coming from the mixtures containing sodium carbonate.

The system which is subject to conversion in its proper physical conditions includes a metallic phase which largely occupies the lower zone of the converter, which phase has a higher specific weight, the metallic phase also being in part dispersed in the form of drops in the zone above, occupied preponderantly by the emulsifed liquid-solid-gas phase indicated generically as slag. This zone is penetrated by the gas phase, that is to say the oxygen. Both the lime which has not yet been dissolved and the brickettes of sodium carbonate. Which is admitted according to the process claimed, are in the slag. This latter, as said above, comes into contact with the metal when it succeeds in reaching the lateral sides of the oxygen gets which drag it into the melt.

Another important possibility for contact between the phases is through the metal particles produced by the impact of the oxygen and which reach the emulsion. The undissolved part of the lime and of the sodium carbonate brickettes is not active for the purposes of the reaction with the metallic melt. In the case of the second one, there is also the possibility that a part of the dissociation products, that is to say $Na_2O$ and sodium, evaporates, removing itself from the system, before carrying out its action.

It should also be noted that the degree of conversion at the end of blowing the desulphurization and dephosphorization reactions is determined by the integral defined by the relation (1) extended from the beginning to the end of blowing. Said degree of conversion determines the efficiency of the process and thus affects the cost of the conversion. The most recent conversion processes have been proposed with various devices, all directed to improving the mixing of the phases present, to increase the degree of conversion of the reactions. This conversion degree can also be defined as the degree to which the thermodynamic equilibrium between slags and the melt is achieved, for the various reactions. The process of blowing the oxygen in unstationary manner is among such recent known processes. It is based on the cyclical variation in the penetration capacity of the individual jets of a multi-jet lance or tuyere. The supplementary movements which are generated in the slag with this process in which the oxygen is supplied with a pulsed feed, are such as notatably to improve the exchange of materials between the phases.

Consequently the last objective of the new process proposed is constituted by the combination of the process according to the invention and the cited blowing in unstationary manner process. The advantages coming from such a combination result from the simultaneous improvement in all the factors which determine the efficiency of mass transport.

In addition to the improvement already illustrated above in the term K determined by the contribution of the sodium compounds present in the slag, one also obtains an increase in the exchange surfaces caused by better mixing; taking into account the notable heterogeneity of the slag (a most evident characteristic even at the end of blowing in normal conversion processes), the improved mixing of the mixed process allows one also to obtain an improvement in the term $[x]-(x)/\eta$ that is to say of the disequilibrium by way of a reduction of $(x)/\eta$, both locally and in the various moments and also in overall terms, as a reduction in the value [x] at the end of conversion.

What we claim is:

1. A process of refining iron to convert iron to steel in an oxygen converter, wherein oxygen is blown into a metallic bath including said iron and slag containing basic compounds selected from CaO, MgO and MnO to desulfurize and dephosphorize the metallic bath, comprising charging sodium carbonate into said metallic bath while blowing oxygen thereto, said sodium carbonate being in the form of brickettes or granules of about 5 to 100 mm. in size, whereby said sodium carbonate is converted to $Na_2O$ in said metallic bath and said $Na_2O$ enhances the desulfurization and dephosphorization of said bath.

2. A method of enhancing the dephosphorization and desulfurization of a metallic bath in an oxygen converter in which iron is converted to steel by blowing oxygen into the metallic bath which includes iron and slag containing CaO, MgO and MnO to desulfurize and dephosphorize the metallic bath, comprising charging sodium carbonate in the form of brickettes or granules of about 5 to 100 mm. in size to the metallic bath in said converter while blowing oxygen thereto, whereby said sodium carbonate is converted to $Na_2O$ in said metallic bath and said $Na_2O$ enhances the dephosphorization and desulfurization of said metallic bath.

3. The refining process according to claim 1, wherein the refining process is carried out in an LD type converter with oxygen blowing from above by means of lances and the sodium carbonate is added to the liquid bath during the oxygen blowing from above the converter.

4. The process according to claim 1 wherein the oxygen blowing is carried out by blowing in an unstationary manner, in such a way as to achieve better mixing of the liquid metal-slag phases and wherein the $Na_2O$ coming from the dissociation of sodium carbonate added to the bath is taken up by the slag.

5. The process according to claim 1 wherein said sodium carbonate, is charged during the initial phase of blowing within the first minutes thereof to ensure sufficient time for the reactions between slag containing $Na_2O$ and the metallic bath.

6. The process according to anyone of claims 3 to 5 and 1 wherein the sodium carbonate charge is divided into two parts, the first part of which is added in the initial phase of blowing whilst the second is added in the last quarter of the blowing period, in the phase of maximum desulphurization and dephosphorization reaction efficiency.

7. The process according to anyone of claims 4 to 6 and 1 wherein said metallic bath contains silica, silicon or both and wherein sodium carbonate is charged after a scorification or slagging operation on the metallic bath and after a third of the total blowing time, that is after the period in which silicon is burnt, said slagging operation eliminating the negative effect of the reactions between sodium oxide and silicon or between sodium oxide and silica.

* * * * *